United States Patent [19]

Burns

[11] Patent Number: 4,664,554

[45] Date of Patent: May 12, 1987

[54] PRESSURIZED LIQUID FILLED TENDONS

[75] Inventor: Gerald E. Burns, Walnut Creek, Calif.

[73] Assignee: Chevron Research Company, San Francisco, Calif.

[21] Appl. No.: 849,666

[22] Filed: Apr. 9, 1986

Related U.S. Application Data

[63] Continuation of Ser. No. 508,764, Jun. 28, 1983, abandoned.

[51] Int. Cl.[4] ..... E02B 17/00

[52] U.S. Cl. ..... 405/211; 114/265; 405/224

[58] Field of Search ..... 405/157, 195, 211, 224, 405/227; 114/264, 265; 285/93

[56] References Cited

U.S. PATENT DOCUMENTS

| | | | |
|---|---|---|---|
| 4,226,555 | 10/1980 | Bourne et al. | 405/224 |
| 4,285,615 | 8/1981 | Radd | 405/211 |
| 4,425,054 | 1/1984 | Blondy et al. | 405/211 |
| 4,521,135 | 6/1985 | Silcox | 405/224 |

*Primary Examiner*—David H. Corbin

*Attorney, Agent, or Firm*—S. R. LaPaglia; E. J. Keeling; V. A. Norviel

[57] ABSTRACT

Pressurized liquid filled tubular tendons provide a means for detecting leaks therein. Filling the tendon with a liquid having a specific gravity less than that of sea water provides increased buoyancy and reduces the weight supported by the buoyant structure. The use of a corrosion inhibiting liquid reduces the corrosion of the interior tendon wall.

15 Claims, 3 Drawing Figures

PRESSURIZED LIQUID FILLED TENDONS

This is a continuation of application Ser. No. 508,764, filed June 28, 1983, now abandoned.

INTRODUCTION

The present invention relates generally to tension leg platform tendons. More particularly, the present invention relates to pressurized liquid filled tendons for detecting leaks, providing buoyancy and resisting corrosion. A change in pressure denotes a structural deficiency. An increase in tendon buoyancy reduces the weight supported by the buoyant structure. Corrosion resistance extends the useful life of the tendon.

BACKGROUND OF THE INVENTION

In deep water, the use of bottom-founded structures for oil well drilling and production operations is cost prohibitive due to the expense for fabrication and installation of such large structures. For water depths in excess of 1,000 feet, buoyant offshore structure moored to the sea floor can be used to perform drilling and production operations cost effectively.

As water depth exceeds 1,000 feet, the tension leg platform (TLP) concept can be introduced to perform oil drilling and production operations. A TLP consists of a buoyant offshore structure moored to fixed sea floor anchor points with vertical tension legs; also referred to as tendons. Drilling, producing and processing equipment as well as crew's quarters are contained in or on the buoyant offshore structure.

Tendon designs include both cable and tubular leg elements. U.S. Pat. No. 4,285,615, issued Aug. 25, 1981 to Frederick J. Radd discloses, "A mooring apparatus for a structure floating on a body of water, comprising: a corrosion resistant cable system, including a multistrand cable, having voids between adjacent strands;". U.S. Pat. No. 4,226,555, issued Oct. 7, 1980 to Henry A. Bourne, Jr. discloses, "A mooring system for a tension leg platform, comprising: a tension leg, including a plurality of tubular leg elements having threaded connections between adjacent leg elements;".

The use of pre-tensioned vertical mooring elements prevents vertical motion but permits travel motion of the floating structure during the passage of waves. Pretensioning is accomplished by deballasting the buoyant offshore structure after the tendons are connected between the buoyant structure and fixed sea floor anchor bases.

Tendon inspection is necessary as both a maintenance expenditure and safety precaution. Tendon repair and replacement are both very expensive and laborious operations. Cracks and corrosion due to exposure to sea water decrease the failure load and working lifetime of the tendon. The desirability of minimizing tendon corrosion has been recognized in the art. Previously cited U.S. Pat. No. 4,285,615 discloses an invention for providing a corrosion resistant design for a tension leg cable which isolates the steel wire cable from the sea water environment.

The present invention provides a method and means for detecting structural deficiencies in a tubular tendon, increasing its buoyancy and extending its useful life.

SUMMARY OF THE INVENTION

The present invention provides a method and means for detecting leaks in a tubular tendon, increasing its buoyancy and extending its useful life. A plurality of tendon segments, each consisting of a tubular element and sealable couplings, are joined to provide a single elongated tubular tendon. The tubular tendon is filled with a corrosion inhibiting liquid having a specific gravity less than that of sea water. A compressor is utilized to pressurize contents of the tubular tendon and pressure gauges monitor variations in pressure.

The corrosion inhibiting liquid protects the interior tendon wall from salt water corrosion. The liquid having a specific gravity less than that of sea water increases the buoyancy of each tendon, thereby reducing the weight supported by the buoyant offshore structure. Variations in pressure indicate cracks or punctures through the tendon or an inadequate coupling seal.

PRINCIPAL OBJECT OF THE INVENTION

The object of the present invention is to provide a method and means for detecting leaks in a tubular tendon, increasing its buoyancy and extending its useful life. A method and means for detecting leaks indicating structural deficiencies promotes safety and reduces routine maintenance expenditures. Increasing the buoyancy of the tendon reduces the weight supported by the buoyant offshore structure; permitting a more efficient design. Increased tendon life provides more cost effective deep water drilling by reducing maintenance, repair and replacement of the tendons.

Another object of the present invention is to provide an improved design for a tension leg platform incorporating the invention described herein.

Additional objects and advantages of the present invention will become apparent from a detailed reading of the specification and drawings which are incorporated herein and made a part of this invention.

DESCRIPTION OF THE PREFERRED EMBODIMENT

Figure 1:
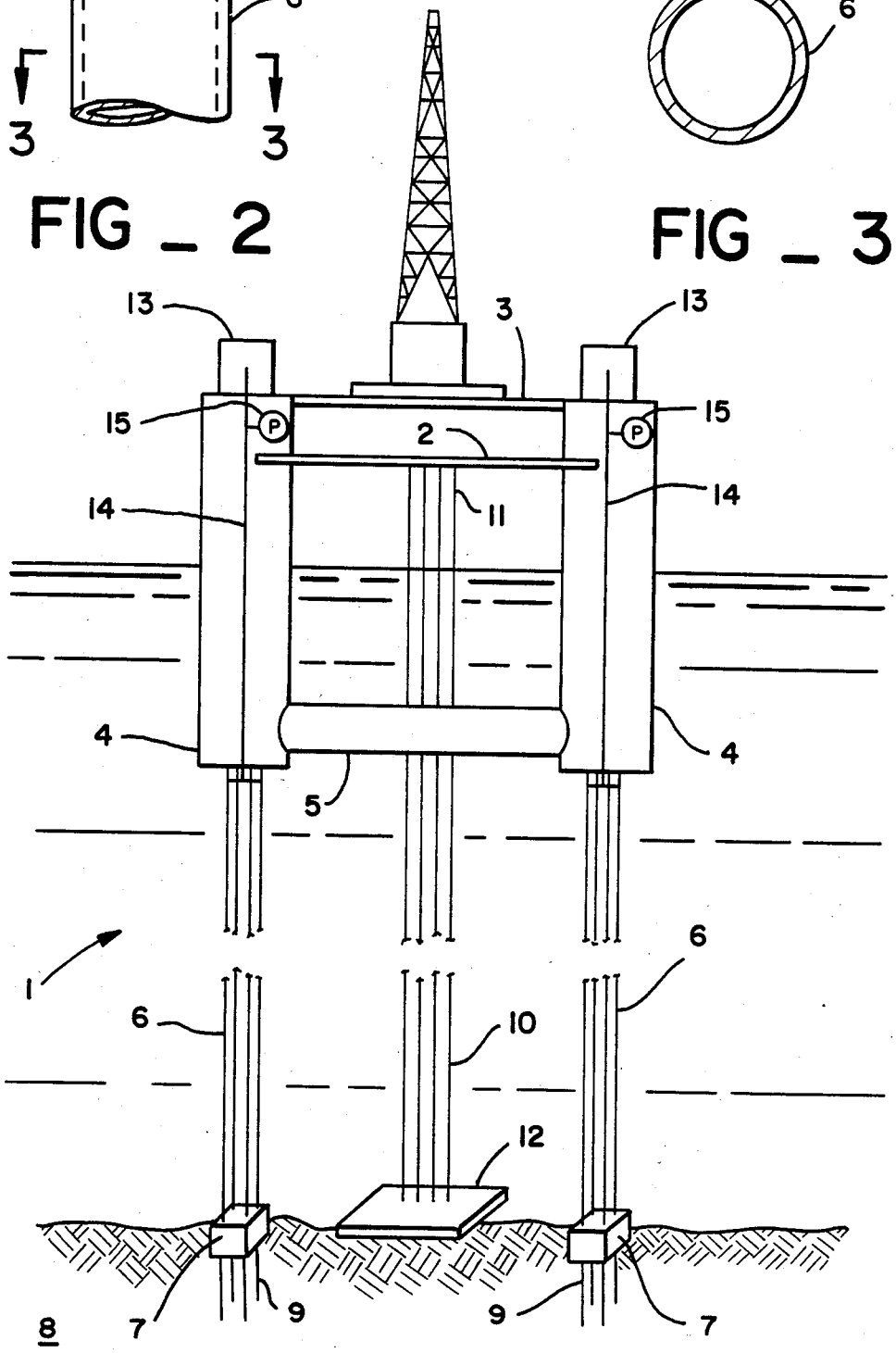
FIG. 1 is an elevation schematic view, partially in section, of a tension leg platform.

FIG. 1 shows an elevation schematic view, partially in section, of a tension leg platform (TLP) 1 deployed at a drilling site. A lower platform 2 is provided on which may be mounted crew's living quarters, well test equipment and processing equipment. An upper platform 3 is provided on which may be mounted a pilot house, cranes, the drilling derrick, skid base, the drill string and a helicopter landing site. Similar conveniences as are known to those skilled in the art of oil exploration and production may also be stored on the lower and upper platforms. Platforms 2 and 3 are supported by a plurality of annular support columns 4. When the TLP is in its illustrated bouyant condition, columns 4 and pontoons 5 extend beneath the surface of the water. A plurality of tendons 6 extend from each support column 4 to anchor means consisting of a foundation template 7 secured to the sea floor 8 with friction piles 9, thereby restricting movement of the structure. A drill string 10 and risers 11 extend from platform 1 or 2 between pontoons 5 to the sea floor 8 during drilling and producing operations. Well template 12 maintains the risers in a stationary position relative to the sea floor 8.

Figure 2:
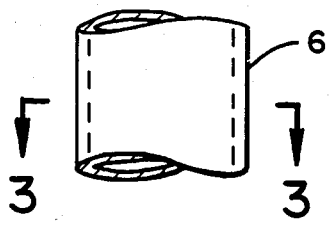
FIG. 2 is an enlarged detailed view of the tendon of FIG. 1.
Figure 3:
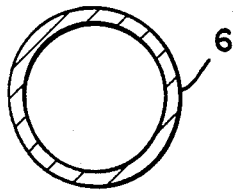
FIG. 3 is a section view of the tendon of FIG. 2 taken about line 3—3.

Referring to FIG. 2, an enlarged detailed view of tendon 6 depicts the tendon as a tubular element. A plurality of tendon segments, each consisting of a tubular element and sealable couplings, are joined to provide a single elongated tubular tendon. The tubular element typically has a relatively thin wall compared to its overall diameter. A tubular element has been designed utilizing inside and outside diameters of 18 and 20 inches, respectively. FIG. 3 shows a section view of the tendon of FIG. 2 taken about line 3—3.

In accordance with the present invention, a liquid; preferably corrosion inhibiting and having a specific gravity less than that of sea water, enters the tendon through a conduit located at its upper end. A liquid mixture of fresh water and hydrazine fulfill the preceding criteria.

Subsequent to the introduction of liquid to the tendon, compressor 13 supplies pressure through the conduit 14 to the tendon's contents. A pressure in excess of the maximum hydrostatic pressure exerted by the sea water on the tendon is recommended to avoid the instance where the pressure inside the tendon is equal to the sea water pressure at the same elevation. A positive net internal pressure is utilized to detect a leak. A valve is closed to retain the pressurized contents. Pressure gauges 15 monitor the pressure therein. Reductions in pressure, in excess of a predetermined value, activate a signal to inform crew members of a deficient tendon.

The corrosion inhibiting liquid protects the interior walls of the tubular tendon from exposure to sea water. A liquid having a specific gravity less than that of sea water provides buoyancy and reduces the tendon weight supported by the offshore buoyant structure. Barring any pressurizing malfunctions, a change in pressure indicates a leak in the tendon attributable to a crack or puncture through the tendon or an inadequate coupling seal.

While a certain preferred embodiment has been specifically disclosed, it should be understood that the invention is not limited thereto, as many variations will be readily apparent to those skilled in the art and the invention is to be given its broadest possible interpretation within the terms of the following claims.

What is claimed is:

1. Apparatus for detecting a leak in a tension leg platform tendon, comprising:
   - a fluid-tight tensioned tubular tendon, said tendon connected on its upper end to a buoyant offshore structure and on its lower end to an anchor means, said anchor means connected to the sea floor;
   - means for supplying liquid to said tendon;
   - means for pressurizing said liquid in excess of the maximum hydrostatic pressure exerted by the sea water on said tendon, and
   - means for monitoring pressure, said means monitoring variations in liquid pressure to said tendon.

2. Apparatus as recited in claim 1, wherein: said liquid is water.

3. Apparatus as recited in claim 1, wherein: said liquid is a hydrocarbon.

4. Apparatus as recited in claim 1, wherein: said liquid includes a corrosion inhibitor mixed therewith.

5. Apparatus as recited in claim 1, wherein: said liquid has a specific gravity less than that of sea water.

6. Apparatus for detecting a leak in a tension leg platform tendon, comprising:
   - a buoyant offshore structure;
   - anchor means connected to the sea floor;
   - at least one tensioned tubular tendon connected between said buoyant offshore structure and said anchor means, said tendon being a fluid-tight tubular member;
   - means for supplying liquid to said tendon in excess of the maximum hydrostatic pressure exerted by the sea water on said tendon;
   - means for monitoring pressure, said means monitoring variations in liquid pressure in said tendon.

7. Apparatus as recited in claim 6, wherein: said liquid is water.

8. Apparatus as recited in claim 6, wherein: said liquid is a hydrocarbon.

9. Apparatus as recited in claim 6, wherein: said liquid includes a corrosion inhibitor mixed therewith.

10. Apparatus as recited in claim 6, wherein: said liquid has a specific gravity less than that of sea water.

11. A method for detecting a leak in a tension leg platform tendon, comprising the steps of:
   - connecting a tensioned tubular tendon between a buoyant offshore structure and an anchor means connected to the sea floor, said tendon being a fluid-tight tubular member;
   - supplying a liquid to said tendon;
   - pressurizing said liquid in excess of the maximum hydrostatic pressure exerted by the sea water on said tendon;
   - monitoring liquid pressure in said tendon to detect leaks therein.

12. The method of claim 11 such that said liquid is water.

13. The method of claim 11 such that said liquid is a hydrocarbon.

14. The method of claim 11 such that said liquid includes a corrosion inhibitor mixed therewith.

15. The method of claim 11 such that said liquid has a specific gravity less than that of sea water.

* * * * *